US010718202B2

(12) United States Patent
McCoy

(10) Patent No.: US 10,718,202 B2
(45) **Date of Patent: *Jul. 21, 2020**

(54) INSTRUMENTED WELLBORE CABLE AND SENSOR DEPLOYMENT SYSTEM AND METHOD

(71) Applicant: TouchRock, Inc., Magnolia, TX (US)

(72) Inventor: Brian Kelly McCoy, Magnolia, TX (US)

(73) Assignee: Touchrock, Inc., Magnolia, TX (US)

( * ) Notice: Subject to any disclaimer, the term of this patent is extended or adjusted under 35 U.S.C. 154(b) by 117 days.

This patent is subject to a terminal disclaimer.

(21) Appl. No.: 15/997,013

(22) Filed: Jun. 4, 2018

(65) Prior Publication Data

US 2018/0283166 A1 Oct. 4, 2018

Related U.S. Application Data

(63) Continuation-in-part of application No. 14/639,541, filed on Mar. 5, 2015, now Pat. No. 9,988,893.

(51) Int. Cl.

| | |
|---|---|
| ***E21B 47/01*** | (2012.01) |
| ***E21B 19/08*** | (2006.01) |
| ***E21B 17/02*** | (2006.01) |
| ***E21B 47/00*** | (2012.01) |

(52) U.S. Cl.
CPC ..... *E21B 47/011* (2013.01); *E21B 17/026* (2013.01); *E21B 19/08* (2013.01)

(58) Field of Classification Search
CPC ..... E21B 47/011; E21B 17/026; E21B 19/08; E21B 47/01; E21B 47/00
See application file for complete search history.

(56) References Cited

U.S. PATENT DOCUMENTS

| | | | |
|---|---|---|---|
| 6,446,723 | B1 | 9/2002 | Ramos et al. |
| 6,910,534 | B2 | 6/2005 | Linyaev et al. |
| 7,455,106 | B2 | 11/2008 | Veneruso et al. |
| 7,552,764 | B2 | 6/2009 | Weems et al. |
| 7,617,873 | B2 | 11/2009 | Lovell et al. |
| 7,654,315 | B2 | 2/2010 | Du et al. |
| 7,784,537 | B2 | 8/2010 | Baxter |
| 7,845,061 | B2 | 12/2010 | Buytaert et al. |
| 8,082,988 | B2 | 12/2011 | Redlinger et al. |
| 8,678,088 | B2 | 3/2014 | Brown |
| 8,720,553 | B2 | 5/2014 | Tips et al. |
| 8,737,774 | B2 | 5/2014 | MacDougall et al. |

(Continued)

FOREIGN PATENT DOCUMENTS

WO 2013134201 A1 9/2013

OTHER PUBLICATIONS

Weatherford, Roller Cross-Coupling Control-Line Protector, Weatherford Cementing Products Brochure 2012, 3 pages.

(Continued)

*Primary Examiner* — Giovanna Wright
*Assistant Examiner* — Manuel C Portocarrero
(74) *Attorney, Agent, or Firm* — David W. Carstens; James H. Ortega; Carstens & Cahoon, LLP

(57) ABSTRACT

A system and method for rapid deployment of fiber optic distributed sensing cables, conventional electronic cables, or hydraulic control lines in the annulus of a wellbore along a specific well zone without the need to clamp cables to the casing or tubing string for support.

20 Claims, 13 Drawing Sheets

(56) References Cited

U.S. PATENT DOCUMENTS

| | | | | |
|---|---|---|---|---|
| 8,746,337 | B2 | 6/2014 | Grigsby et al. | |
| 8,800,650 | B2 | 8/2014 | Spray et al. | |
| 9,988,893 | B2 * | 6/2018 | McCoy | E21B 47/00 |
| 2001/0050111 | A1 | 12/2001 | Neuroth et al. | |
| 2005/0236161 | A1 | 10/2005 | Gay et al. | |
| 2006/0151194 | A1 | 7/2006 | Varkey et al. | |
| 2008/0006400 | A1 | 1/2008 | Coyle, Jr. | |
| 2008/0041596 | A1 | 2/2008 | Blount et al. | |
| 2008/0066905 | A1 | 3/2008 | Aivalis et al. | |
| 2012/0010846 | A1 | 1/2012 | Brian et al. | |
| 2013/0118757 | A1 | 5/2013 | Barrilleaux et al. | |
| 2013/0309888 | A1 | 11/2013 | Nicholson | |
| 2014/0083714 | A1 | 3/2014 | Grigsby | |
| 2014/0144615 | A1 | 5/2014 | Richards | |
| 2014/0202767 | A1 | 7/2014 | Feasey | |

OTHER PUBLICATIONS

TubeTec Website Encapsulated Control Line Print Screen printed Sep. 16, 2014, from http://www.tubetec.co.uk/ 1 page.
Tesco Corporation, Multiple Control Line Running System (MCLRS), Tesco bulletin 47100e 2008, 1 page.
Schlumberger, Permanent Downhole Cable Product Information Sheet 2014, 2 pages.
Prysmian Group, Tubing Encapsulated Cable Brochure, 6 pages.
Halliburton, Flatpack, Completion Solutions Brochure 2013, 1 page.

* cited by examiner

INSTRUMENTED WELLBORE CABLE AND SENSOR DEPLOYMENT SYSTEM AND METHOD

CROSS REFERENCE TO RELATED APPLICATIONS

This disclosure is a continuation-in-part application of U.S. Ser. No. 14/639,541, filed Mar. 5, 2015, the entirety of which is incorporated herein by reference for all purposes.

FIELD OF THE INVENTION

The present invention generally relates to deployment of instrument cables and control lines in an oil and gas wellbore. Specifically, the present invention provides a system and method for rapid deployment of fiber optic sensors and distributed sensing cables, electronic sensors and conventional electronic cables, capillary tubing, or hydraulic control lines in the annulus of a wellbore along a specific well zone without the need to clamp cables to the casing or tubing string for support.

PRIOR ART AND BACKGROUND OF THE INVENTION

Prior Art Background

Economic challenges have created the necessity for increased efficiency and precision of hydrocarbon production methods. Deploying instruments into the wellbore that capture data from specific zones can help achieve these efficiencies.

Advancements in distributed fiber optic sensing ("DxS") technologies have resulted in such technologies becoming economically competitive with conventional logging methods. The barrier to wider use of DxS and other down-hole instruments by well operators has been relatively high installation costs.

In most cases, the standard casing program does not provide adequate clearance for current cable installation. This necessitates upsizing the entire casing and wellbore program to accommodate the necessary fiber cables, "marker" cables and associated clamps or centralizers that are run on the outside of the casing. The costs associated with drilling larger diameter wellbores can range from $500,000 to over $1 million, per well, in addition to the rig time for placement of clamps and centralizers.

The current industry practice for deploying instrumented cables and control lines behind casing or in the casing-tubing annulus is to rigidly attach the cables to the casing or tubing with bands or clamps that support the weight of the cable and deliver it down-hole. These clamps or bands may increase the outer running diameter of the casing string, which may necessitate upsizing of the well-bore to provide sufficient running clearance and reduce the risk of cable damage during installation transit.

While running these types of completions, the casing or tubing cannot be rotated without potential damage to the cables or control lines. The cables and control lines are typically installed from spools located some distance away from the rig. A cable sheave is then suspended above the rig floor to guide and position the cable relatively parallel to the casing or tubing so that it can be manually clamped into place. The suspended sheave load above the rig floor creates a potential safety hazard from failure of the suspending means and the load falling on rig personnel.

It may also be desirable during the drilling phase of a well to temporarily run certain fiber optic or electronic sensors into the annular space between the wellbore and drill pipe to better obtain geophysical parameters. Conventional logging systems are typically run inside the drill pipe which may act as an insulator and attenuate some sensor signals causing erroneous or weak signals.

Deficiencies in the Prior Art

The prior art as detailed above has the following deficiencies:

Prior art systems present a safety hazard to workers on the rig floor due to heavy loads comprising cable sheaves to be suspended above the rig floor.

Prior art systems do not provide for rotation of the casing or tubing without the risk of damaging the sensor cable.

Prior art systems require use of bands or clamps to rigidly attach instrument cables to the outside of the casing which many times requires drilling a larger diameter wellbore and thus increasing operational costs and drilling time.

The prior art systems require labor-intensive efforts to manually attach the instrument cables to the casing thus increasing labor costs and drilling times.

The prior art systems involve the expense of upsizing wellbores to accommodate the bands or clamps on the casing exterior.

Prior art systems are typically not run during the drilling phase of well construction due to the time, expense, and risks associated with clamping or banding cables to the drill pipe.

While some of the prior art may teach some solutions to several of these problems, the core issue of using a system of distributed fiber optic sensing technology within a durable and rugged delivery means to gather well logging data is disclosed as a way to deliver high quality information at lower cost to energy professionals.

Objectives of the Invention

Accordingly, the objectives of the present invention are (among others) to circumvent the deficiencies in the prior art and affect the following objectives:

Utilize a unique type of ruggedized sensor cables with sufficient tensile and crush strength to run between the casing and bore-hole, which can be cemented in place, and be used to gather well logging data.

Eliminate or reduce the need to up-size a wellbore to accommodate cables and sensors.

Provide for positioning of distributed fiber optic sensing means that could be installed or removed in a feasible, economic, and timely manner.

Provide a ruggedized cable of composite construction utilizing multiple reduced outside diameter sensor cables within a protective polymer sheath for impact resistance; lined with a low-friction polymer on the casing side, to reduce potential twisting during casing rotation; and lined with metal sheath on the wellbore side that is crimped onto the polymer and cables to prevent separation.

Other concepts are to use full encapsulation with dual-polymer extrusion with low-friction surface, combinations of polymers with high-strength composite materials such as carbon fiber and steel, or full metal encapsulation in a "flat-pack" arrangement with welded seams.

Provide for increased running speeds and reduced manpower and rig-time needs by eliminating rigid casing clamps at each pipe joint.

Provide for self-supporting, ruggedized instrument cable by installing rotating cable hangers at strategic intervals which results in achieving near normal run-rates during casing deployment and makeup.

Provide for rotation of the casing string through tight spots, eliminate or reduce the need for reamer runs, and improve cementing efficiency where reciprocation is required. The rotating casing hangers allow free rotation movement of the pipe and may (or may not) provide some limited axial movement of the casing with the hangers.

Providing a system of metal sheathing or encapsulation in the composite construction to induce a high magnetic flux signature and allow use of existing magnetic mapping tools when required. Such magnetic flux may be increased by adding Ferro-magnetic particles to the encapsulating polymer matrix.

Providing a system compatible with conventional plug and perforation completions, conventional frack sleeve systems, and swell packers.

Provide a system that increases the safety of personnel during running operations While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention, in various embodiments, provides a system and method to provide rapid deployment of fiber optic sensing cables, conventional electronic cables, or hydraulic control lines in the annulus of a wellbore without the need to clamp cables to the casing or tubing string for support, the system comprising:

A cable anchor sub-assembly;

Cable carriers;

Ruggedized cable; and

Specialized surface deployment equipment.

The method in broad aspect is the use and activation of the apparatus as described.

Method Overview

The present invention system may be utilized in the context of an overall resource extraction method, wherein the instrumented wellbore cable and sensor deployment system described previously is controlled by a method having the following steps:

(1) installing the wellbore casing to the proper depth;

(2) deploying the flexible polymer cable along with anchor subassembly and intermediate cable carriers to the target location in the wellbore;

(3) connecting sensor or communication cables embedded in flexible polymer cable to surface equipment;

(4) confirming flexible polymer cable is deployed to target location in wellbore;

(5) energizing the sensors and gather geophysical data;

(6) performing well stimulation such as acidizing or fracturing, if required;

(7) checking if all data has been collected, if not, proceeding to step (2); and (8) pumping or flowing the resource from the well;

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DETAILED DESCRIPTION OF THE PRESENTLY PREFERRED EXEMPLARY EMBODIMENTS

Figure 1:
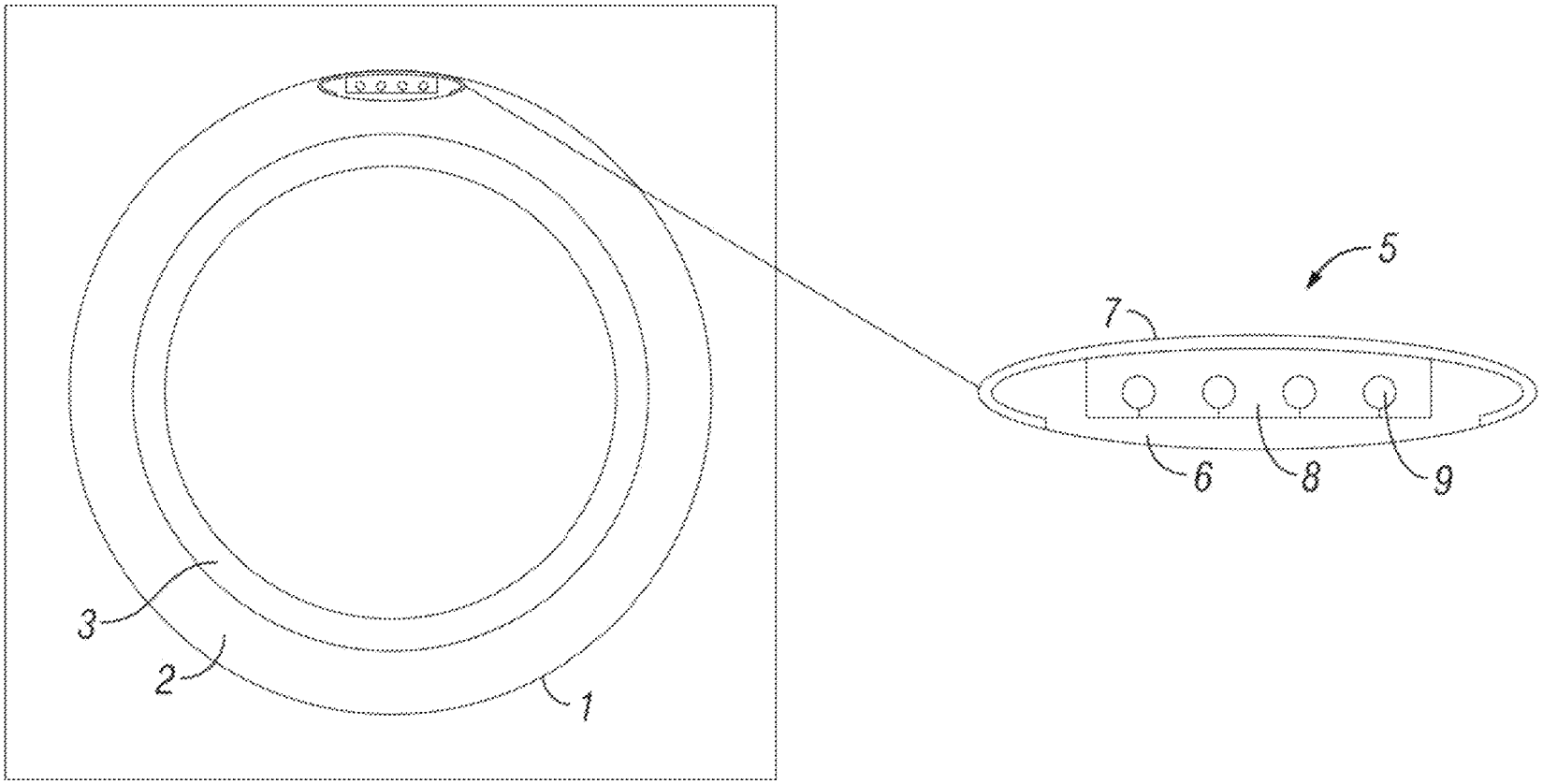
FIG. 1 is a top view depicting an exemplary embodiment of the instrumented wellbore cable 5 deployed in a borehole 1.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of an instrumented wellbore cable and sensor deployment system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The present invention is an improved instrumented wellbore cable and sensor deployment system and method to gather data from areas of interest in the rock formation surrounding a wellbore by using an instrumented cable that is not rigidly attached to the casing at every joint. The apparatus allows rotation of the casing to improve running and cementing, and allows use of existing magnetic orienting tools for cable location, eliminates the need for cable sheaves hanging about the rig floor, and comprising;

(a) A flexible polymer cable with embedded wires, (b) A system for deploying said flexible polymer cable, (c) A means to hold the flexible polymer cable along a casing wall surface to allow sensing of at least one wellbore parameter.

Wherein

The system is configured to coaxially fit within a wellbore;

The system is configured to provide an articulating hydraulic arm to deploy the cable and sensors from a cable spool to the drilling rig and down into the wellbore;

The system is configured to allow rotation of the wellbore casing or tubing within the longitudinal axis of cable carriers; and The anchor subassembly and the intermediate cable carriers are configured to support the weight of the flexible polymer cable in the downhole environment.

This general system summary may be augmented by the various elements described herein to produce a wide variety of invention embodiments consistent with this overall design description.

DETAILED DESCRIPTION OF THE PREFERRED EMBODIMENTS

Referring to FIG. 1, a flexible polymer cable 5 in accordance with one preferred embodiment is shown deployed in a wellbore 1. As generally illustrated in FIG. 1, a casing 3 is deployed in a borehole with a ruggedized flexible polymer cable 5 situated adjacent to the wellbore 1 and surrounded by cement 2. The flexible polymer cable 5 comprises a plurality of sensor cables 9 (which may include fiber optic cables, electric control lines, or hydraulic control lines) with reduced outside diameter, embedded in an erosion resistant polymer 8, which is itself surrounded by a low-friction polymer 6. A metal sheath 7 is situated around the low-friction polymer 6 outside surface in such way as to protect the cable 5 from abrasive contact with the wellbore 1.

According to one aspect of a preferred exemplary embodiment, cable 5 may be deployed at desired locations to acquire geophysical information from the surrounding formation without the need for clamping the cable 5 to the wellbore casing 3.

Cable 5 may have different types of electronic or optical sensors 9 attached to or imbedded in the cable at various intervals for acquiring geophysical information.

According to another preferred exemplary embodiment, cable 5 is fully encapsulated with low-friction polymer extrusion 6 on one side for casing friction drag reduction, or full metal 7 encapsulation in a "flat-pack" arrangement with welded seams.

Figure 2:
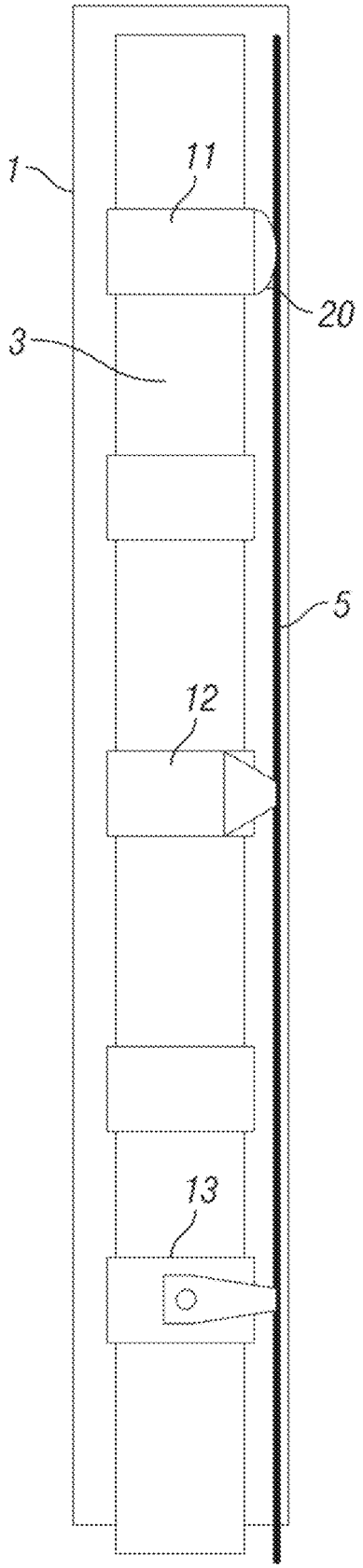
FIG. 2 is a schematic side-view of alternative arrangements of an exemplary embodiment of the invention depicting a bow-spring arm carrier 11, a semi-circular spring-loaded carrier 12, and a spring-loaded rocker arm carrier 13.

According a further preferred exemplary embodiment and referring to FIG. 2, cable 5 is not rigidly clamped to the wellbore casing 3 at each joint, leading to faster completions and reduced rig-time and manpower otherwise used to clamp sensor cables 5 to each casing 3 joint. By installing rotating cable hangers at strategic intervals the cable 5 is self-supporting in the vertical section of the wellbore 1 and near normal run-rates for casing 3 makeup and deployment are achieved. Allowing rotation of the casing string 3 eliminates or reduces the need for reamer runs, and casing 3 can be rotated through tight spots, improves cementing 2 where reciprocation is required. The rotating casing hangers 11, 12, 13 allow free rotational movement of the pipe and may provide limited axial movement of the casing 3 with the hangers 11, 12, 13.

According to yet another preferred exemplary embodiment, cementing the ruggedized cable 5 in place between the casing and the wellbore 1 eliminates or reduces the need for larger wellbore 1 diameter. Furthermore, integrating metal sheathing or Ferro-magnetic particles into the polymer matrix 6, 8 creates high magnetic flux signature for the cable 5, and allows the cable 5 to be located with existing magnetic mapping tools. Locating the relative orientation of the cable allows perforating guns to be configured to shoot unidirectionally (instead of the typical 360 degree pattern), and avoid the cable 5 by firing the perforation guns away from the relative bearing of the cable 5.

Figure 9:
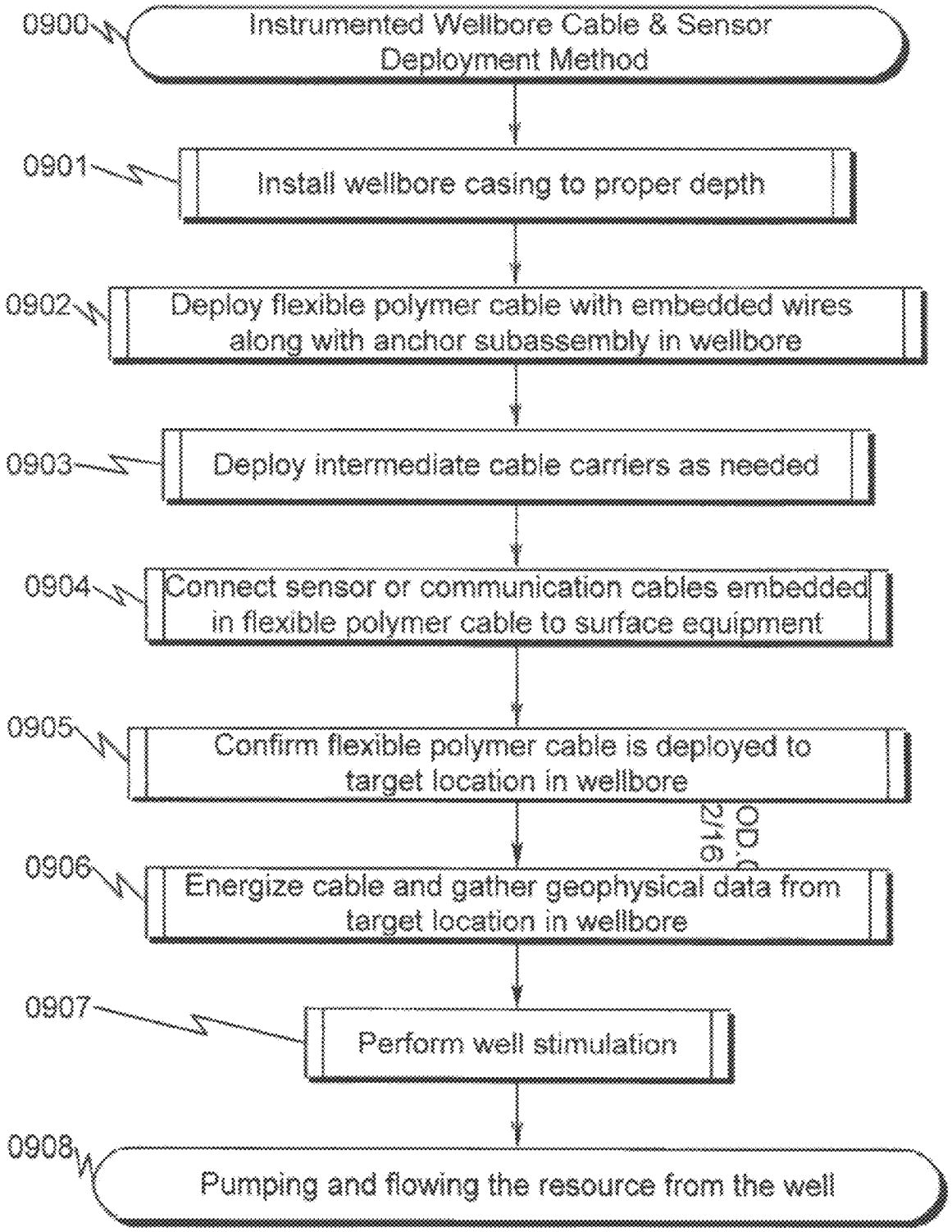
FIG. 9 illustrates an operational flowchart of a preferred exemplary embodiment of a method of using the invention.

Preferred Exemplary Instrumented Wellbore Cable and Sensor Deployment Method Flowchart As generally seen in the flow chart of FIG. 9, a preferred exemplary instrumented wellbore cable and sensor deployment method may be generally described in terms of the following steps:

(1) installing the wellbore casing to the proper location in the wellbore (0901);

(2) deploying the flexible polymer cable with the anchor subassembly in wellbore (0902);

(3) deploying intermediate cable carriers as needed (0903);

(4) connecting the sensor or communication cables embedded in the flexible polymer cable to surface equipment (0904);

(5) confirming the flexible polymer cable is deployed to the target location in the wellbore (0905);

(6) energizing the sensor or communication cables and gathering geophysical data from the target location in the wellbore (0906);

(7) perform well stimulation, as needed (0907);

(8) Pumping and flowing the resource from the well (0908).

Preferred Embodiment Side View Cable Support Carriers

Yet another preferred embodiment may be seen in more detail as generally illustrated in FIGS. 2, 3, 4 and 5, wherein cable support carriers 11, 12, 13 are slipped over the outside of casing 3 with sufficient gap to allow casing 3 to rotate and/or reciprocate inside the carrier 11, 12, or 13, while holding the cable 5 stationary relative to the borehole 1.

Figure 3:
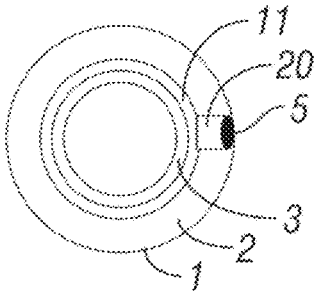
FIG. 3 illustrates a top view of an exemplary embodiment of the bow-spring arm carrier 11.

FIG. 3 depicts a plan view of a bow-spring arm carrier 11 and bow-spring arm 20 positioned over the casing 3 and holding the cable 5 adjacent to the borehole. The bow-spring carrier 11 is free to slide along the casing 3 and allows casing 3 to rotate while the bow-spring arm 20 holds the cable adjacent to the wellbore 1.

Figure 4:
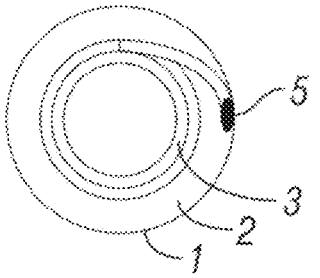
FIG. 4 illustrates a top view of an exemplary embodiment of the semi-circular spring-loaded carrier 12.

FIG. 4 depicts plan view of a spring-loaded longitudinally hinged arm carrier 12 positioned over the casing 3 and holding the cable 5 adjacent to the borehole. The hinged-arm carrier 12 is free to slide along the casing 3 and allows casing 3 to rotate while the hinged arm carrier 12 holds the cable adjacent to the wellbore 1.

Figure 5:
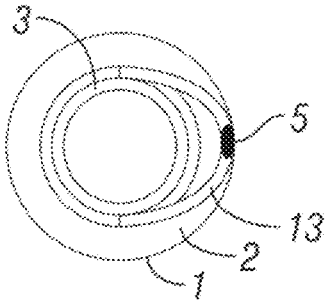
FIG. 5 illustrates a top view of an exemplary embodiment of the spring-loaded hinged arm carrier 13.

FIG. 5 depicts plan view of a spring-loaded hinged arm carrier 13 positioned over the casing 3 and holding the cable 5 adjacent to the borehole. The spring-loaded hinged arm carrier 13 is free to slide along the casing 3 and allows casing 3 to rotate while the spring-loaded hinged arm carrier 13 holds the cable adjacent to the wellbore 1.

Preferred Embodiment Side View of an Anchor Sub-Assembly

Figure 6:
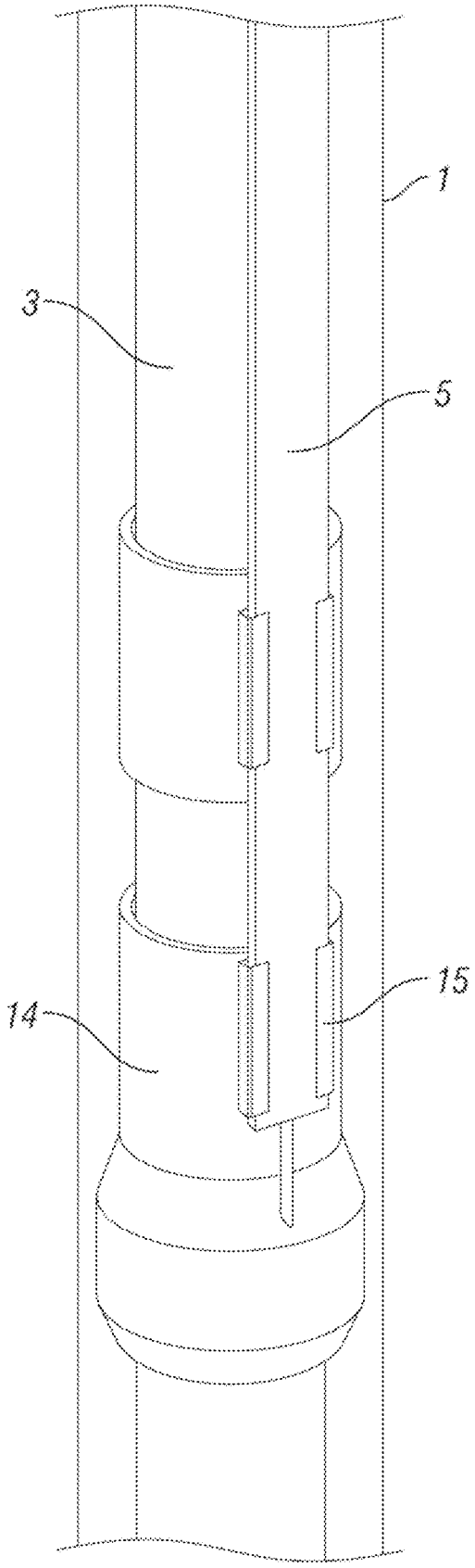
FIG. 6 illustrates an operational side view of an alternative exemplary embodiment of a cable anchor sub-assembly 14 situated on casing 3 within the wellbore 1. The figure depicts the flexible polymer cable 5 attached to the anchor sub-assembly 14 by means of a cable clip 15.

FIG. 6 depicts a preferred embodiment wherein an anchor subassembly 14 is shown downhole in place over the outer surface of a wellbore casing 3. Said subassembly 14 includes a cable clip 15 used to secure the flexible polymer cable 5 to the subassembly 14. The subassembly 14 is slipped over the casing joint 3 at the surface and the instrumented flexible polymer cable 5 is attached to the subassembly 14 before it is transited the wellbore 1 to the desired location.

Figure 7:
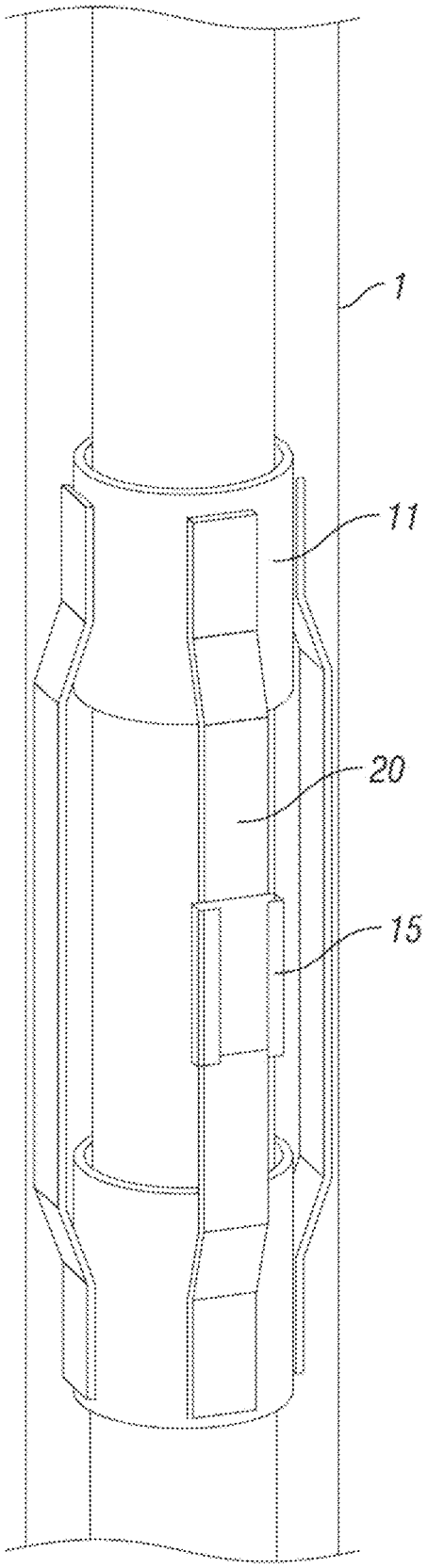
FIG. 7 illustrates an operational side view of the bow-spring carrier 11 of the apparatus shown in FIG. 3 depicting the carrier 20 and cable clip 15, without the cable 5.

FIG. 7 depicts another preferred exemplary embodiment wherein a bow-spring carrier 11 is shown without the cable 5. In the downhole environment, the bow-spring carrier 11 places the instrumented cable 5 adjacent to the wellbore wall 1 with the cable 5 secured in a cable clip 15 attached to the bow-spring arm 20. The bow-spring carrier 11 is fabricated to allow the casing 3 to easily rotate through the subassembly 14 without applying rotational force to the cable 5. A plurality of bow-spring arms 20 are situated around the bow-spring carrier 11 to strengthen the centralizing action and provide an attachment point for the cable 5.

In a preferred embodiment, only a few of the bow-spring carriers 20 would be deployed downhole in the casing string 3, thus minimizing rig-time for installation. After a completed installation to the desired location, the instrumented cables 5 can be terminated at surface points using conventional ported hangers and wellhead exits.

Figure 8:
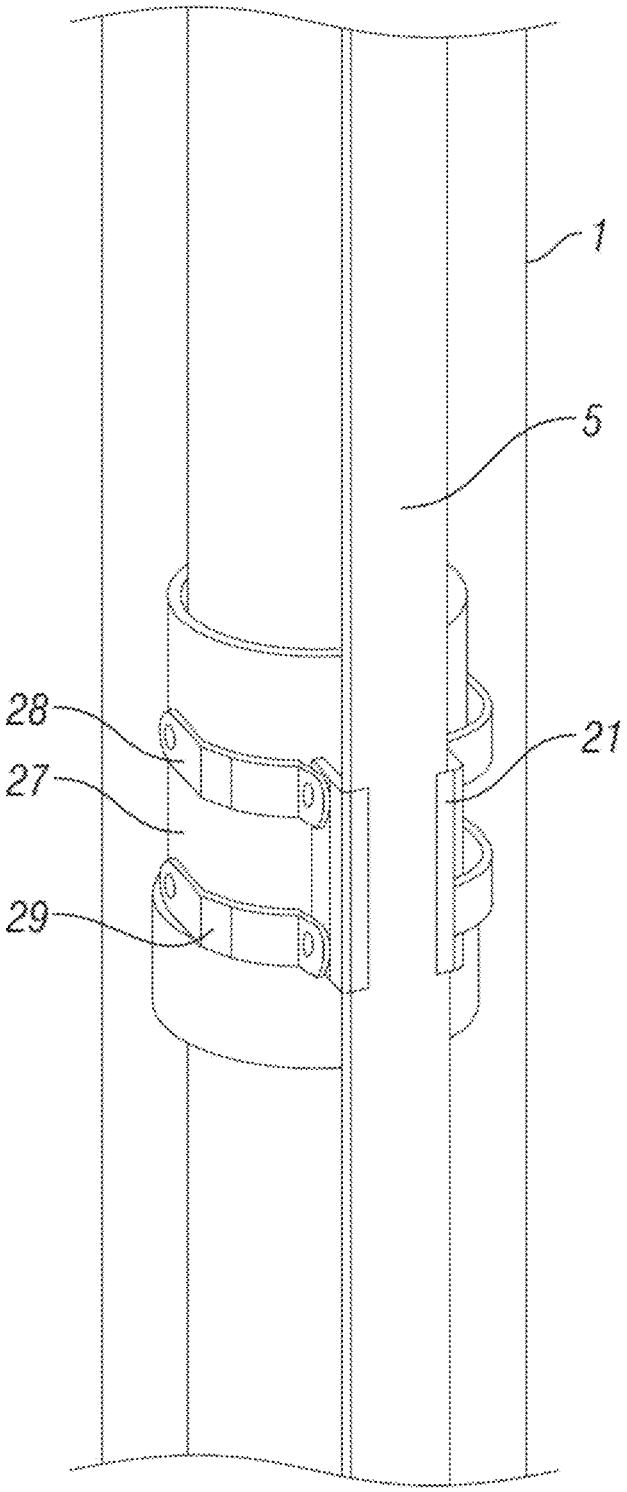
FIG. 8 illustrates an operational side view of an embodiment of a hinged cable carrier 27 depicting the flexible polymer cable 5 attached to a cable clip 21 which is attached to a hinged cable carrier 27 fabricated to allow the casing 1 to rotate through the longitudinal axis of the hinged cable carrier 27 without exerting rotational force to the cable 5. The cable clip 21 is attached to the carrier 27 by an upper hinged bracket 28 and a lower hinged bracket 29. These brackets allow a small degree of mobility in movement of the flexible polymer cable 5.

In another preferred embodiment shown in FIG. 8, the flexible polymer cable 5 is attached to a cable clip 21 which is attached to a hinged cable carrier 27 that is situated in a downhole environment. The hinged cable carrier 27 is fabricated to allow the casing 3 to rotate through the longitudinal axis of the carrier 27 without exerting rotational force to the cable 5. The cable clip 21 is attached to the carrier 27 by an upper hinged bracket 28 and a lower hinged bracket 29. These brackets allow a small degree of mobility in the movement of the flexible polymer cable 5 in the downhole environment.

Also, for down-hole installation of fiber optic cabling or other parameter detecting sensors/devices used for distributed sensing, and for discrete sensors such as seismic transducers or pressure-temperature sensors, there can be benefits to placing the cable or sensor at a particular rotational angle within the wellbore. An example of this could be for placing fiber optic cable or seismic sensors along the upper-most point of a horizontal wellbore to eliminate shadowing effects of the metal casing and thereby increase sensitivity to surface generated seismic sources. An additional benefit of predetermining the orientation of a cable or instruments within the wellbore is for uniform placement of sensors and the potential ambiguity between readings of multiple sensors at different depths that may be caused by non-uniform placement.

Unfortunately, existing systems for instrument and cable deployment on a wellbore tubing or casing do not include methods to selectively position the instruments or cable in a predetermined rotational orientation within the wellbore. Methods such as magnetic detection or acoustic logging must be used after the cable or instruments are installed to "find" the cable (i.e., map the relative bearing) so that perforating charges can be aimed away from the cable or instruments in order to avoid damaging the cable or instruments. The time and expense required to map the cable with the logging tools is considerable, and often times these tools do not accurately locate a cable resulting in damaged cable during the perforation event. Thus, it would also be advantageous to have a system that positions the cable at a planned orientation within wellbore to reduce or eliminate the need for locating or "mapping" tools before perforating. The same advantages would be beneficial in a system where the position of a different parameter detecting device, other than a cable, can be determined.

To address these deficiencies, the disclosed principles also provide for the inclusion of passive or active systems that place the cable, or other parameter detecting device, and the carriers at a predetermined rotational position within the wellbore during deployment. For example, tubing or casing can rotate within the carrier supports and subassemblies discussed herein, and thus are somewhat free to rotate with the wellbore during running. If the parameter detecting device is a cable, cable tension may be applied to help insure the cable remains fairly linear during deployment, but perforating the well still requires mapping with a magnetic or acoustic logging tool to insure perforations are oriented away from the cable or other parameter detecting device. Thus, the disclosed principles provide for carrier orientation systems for use with the carriers that are capable of turning a section of the carrier towards a predetermined or desired rotational position with the wellbore. For example, gravity-based carrier orientation systems can be used to rotate the carriers around the casing and towards the direction of maximum gravitational pull. As such, the applied motive (turning) force assures that the carrier seeks a known or desired orientation as it slides along the wellbore (i.e., the turning overcomes friction to rotate the carrier around the casing as it moves inside the wellbore).

One technique to passively accomplishing this is with a either, or a combination of, weights and/or buoyant devices to allow the automatic rotational orienting of the carrier, and ultimately the cable or other parameter detecting device, to a known position depending on how and where it is attached to the carrier.

Figure 13:
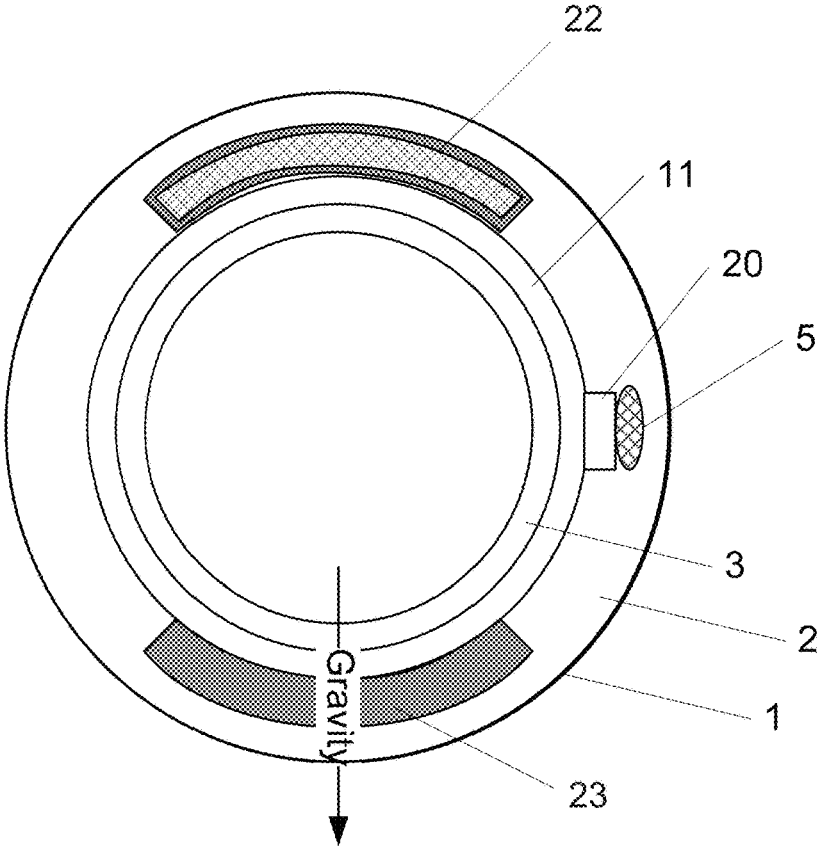
FIG. 13 illustrates a top view of one embodiment of a cable carrier orientation system having a weighted cable orientation subsystem in accordance with the disclosed principles.

Looking at FIG. 13, illustrated is one embodiment of a carrier orientation system having a weighted orientation subsystem in accordance with the disclosed principles. In this embodiment, the carrier orientation system includes a buoyancy device 22, as well as weighting device 23. As illustrated, the buoyancy device 22 and weighting device 23 are located on opposing outer sides of the carrier 11, approximately 180 degrees apart. As discussed above, the carrier 11 is configured to rotate independently of the casing 3. As such, as the casing 3 is deployed into a non-vertical wellbore 1, the weighting device 23, which is connected to the carrier 11, will rotate downwards in the direction of the gravitational pull of the earth. Consequently, since the orientation of the fiber optic cable 5, which is also attached to the carrier 11, is known prior to deployment into the wellbore 1 in relation to the position of the weighting device 23 on the carrier 11, the position of the cable 5 can be determined with specificity throughout the lengths of the wellbore 1. Also, the buoyancy device 22 may also, or alternatively, be attached to the carrier 11 for use when the wellbore hole 2 is filled with water or other fluid. Specifically, the buoyancy device 22 is selected to be buoyant within such fluid, which will then result in the buoyancy device 22 "floating" to the top of a non-vertical wellbore hole 2. As the buoyancy device 22 floats to the top of the non-vertical wellbore hole 2, it will cause the carrier 11 to rotate into a specific position, and consequently cause the fiber cable 5 to be held into a known orientation within the wellbore 1.

The use of either or both of the buoyancy device 22 or weighting device 23 on the carriers 11 may also be employed in systems employing other types of parameter detecting devices other than a communication cable 5. For example, the parameter detecting device may be comprised of a seismic sensor capable of detecting seismic activity, a pressure sensing device capable of determining pressure within at least a portion of the wellbore, or a temperature sensing device capable of determining temperature within at least a portion of the wellbore, or an acoustic device capable of emitting acoustic waves for use in determining at least one parameter within at least a portion of the wellbore.

Another embodiment of a carrier orientation system as disclosed herein would be to have the cable 5 itself that is designed to have relatively negative, neutral, or positive buoyancy in the wellbore fluids. Specifically, the cable itself, or other parameter detecting device, comprises the weighting device, the buoyancy device, or both. For example, a buoyant cable can be employed in one embodiment and would assist the carriers 11 in maintaining a linear alignment along the top of a deviated or horizontal wellbore. In addition, a distributed fiber sensing cable that is "floating" (i.e., buoyant) along the top of a deviated or horizontal wellbore is inherently more sensitive to formation parameters with improved coupling and response to thermal, acoustic, seismic or other types of measurements. A negative buoyancy cable could alternatively be employed, which would lay on the bottom of a deviated or horizontal wellbore and can be more sensitive to temperature fluctuations or noise generated by fluids flowing in the wellbore. For deployment of a cable along the side of a deviated wellbore, a neutrally buoyant cable(s) could be attached to the carrier 11 and would provide a means to assure the cable 5 is primarily positioned and held in place by the cable carrier guides. Each of these implementations may also be achieved with other types of parameter detecting devices aside from a cable 5.

Figure 14:
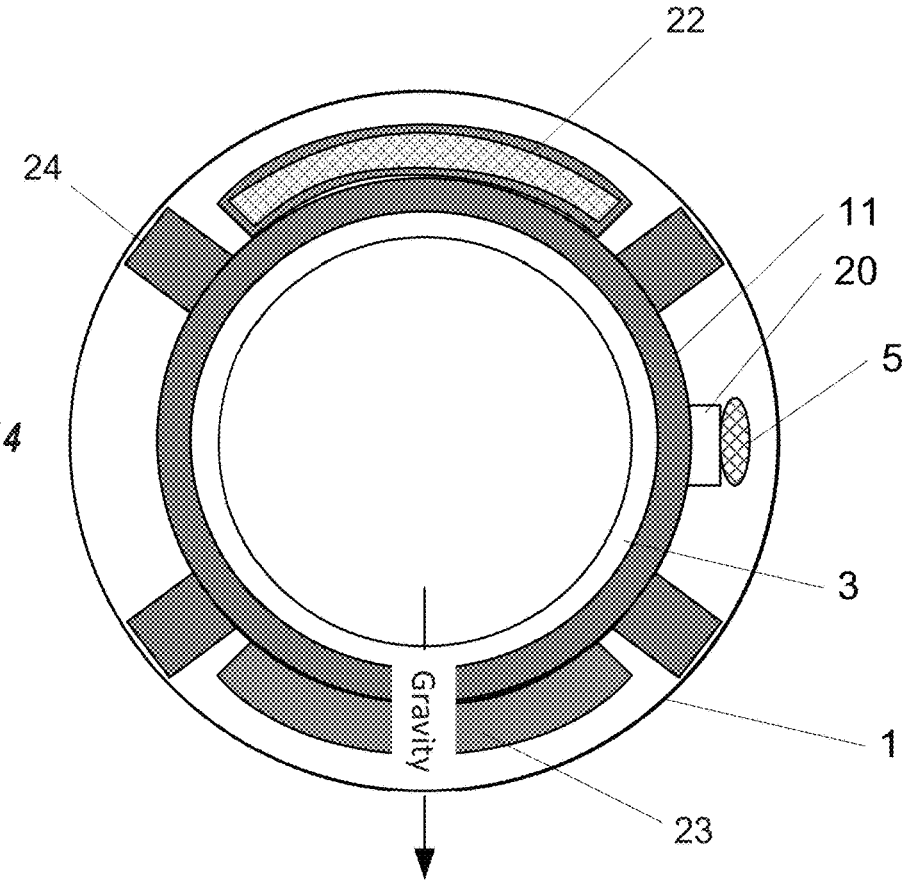
FIG. 14 illustrates a top view of another embodiment of a cable carrier orientation system having a weighted cable orientation subsystem in accordance with the disclosed principles.

Turning to FIG. 14, illustrated is another embodiment of a carrier orientation system having a weighted orientation subsystem in accordance with the disclosed principles. In this embodiment, a buoyancy device 22 and weighting device 23 may again be included and connected on opposing sides of the cable carrier 11. In other embodiments, only one of the buoyancy device 22 or the weighting device 23 may be employed on the carrier 11. Accordingly, these devices 22, 23 can provide the known orientation of the fiber cable 5 as described above. Also, such a carrier orientation system may be used to determine the rotational position of other types of parameter detecting devices. However, this embodiment also includes centralizing devices 24 attached to the carrier 11. While four centralizing devices 24 are illustrated, a greater or lesser number of centralizing devices 24 may also be employed. These centralizing devices 24 are sized to contact the wellbore wall 1 as the casing 3 and carrier 11 are deployed into the wellbore 1. More specifically, the centralizing devices 24 can be made of substantially equal widths extending from the carrier 11. As such, as the carrier 11 rotates around the casing 3 with the assistance of the buoyancy device 22 and/or the weighting device 23, the centralizing devices 24 will keep the casing 3 and carrier 11 substantially concentric within the wellbore wall 1. Therefore, the width of each of the centralizing devices 24 may be selected so that the carrier 11 is still permitted to rotate within the wellbore 1, while still keeping the carrier 11 and casing 3 substantially concentric. The centralizing devices 24 may be comprised of blades, bow springs, rollers, or any other structure capable of assisting in keeping the carrier 11 substantially concentric within the wellbore 1, while still permitting the rotational orientation of the carrier 11.

Figure 15A:
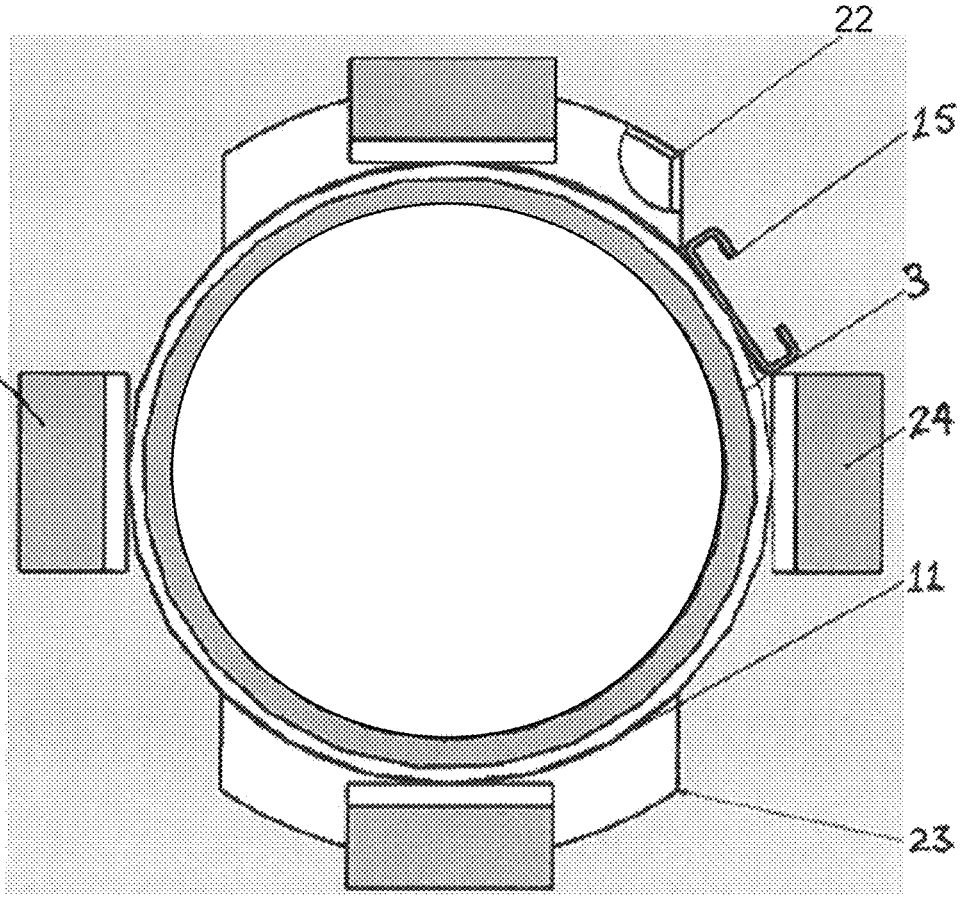
FIG. 15A illustrates a top view of one embodiment of a cable carrier orientation system having a weighted cable orientation subsystem and employing bow springs as centralizing devices.

Turning to FIG. 15A, illustrated is one embodiment of a carrier orientation system having a weighted orientation subsystem, and employing bow springs as centralizing devices. In this embodiment, a buoyancy device 22 and weighting device 23 are again included and connected on opposing sides of the carrier 11, and thus can provide the known orientation of the fiber cable (not illustrated) or other parameter detecting device as described above. Also in this embodiment, a clip 15 may be included to hold the fiber cable or other parameter detecting device in a known orientation on the carrier 11. This embodiment also includes bow springs as the centralizing devices 24 attached to the carrier 11. As before, while four bow springs 24 are illustrated, a greater or lesser number of such centralizing devices may also be employed. These bow springs 24 are again sized to contact the wellbore wall (not illustrated) as the casing 3 and carrier 11 are deployed into the wellbore, while still permitting rotation of the carriers 11 around the casing 3 as biased by the carrier orientation system.

Figure 15B:
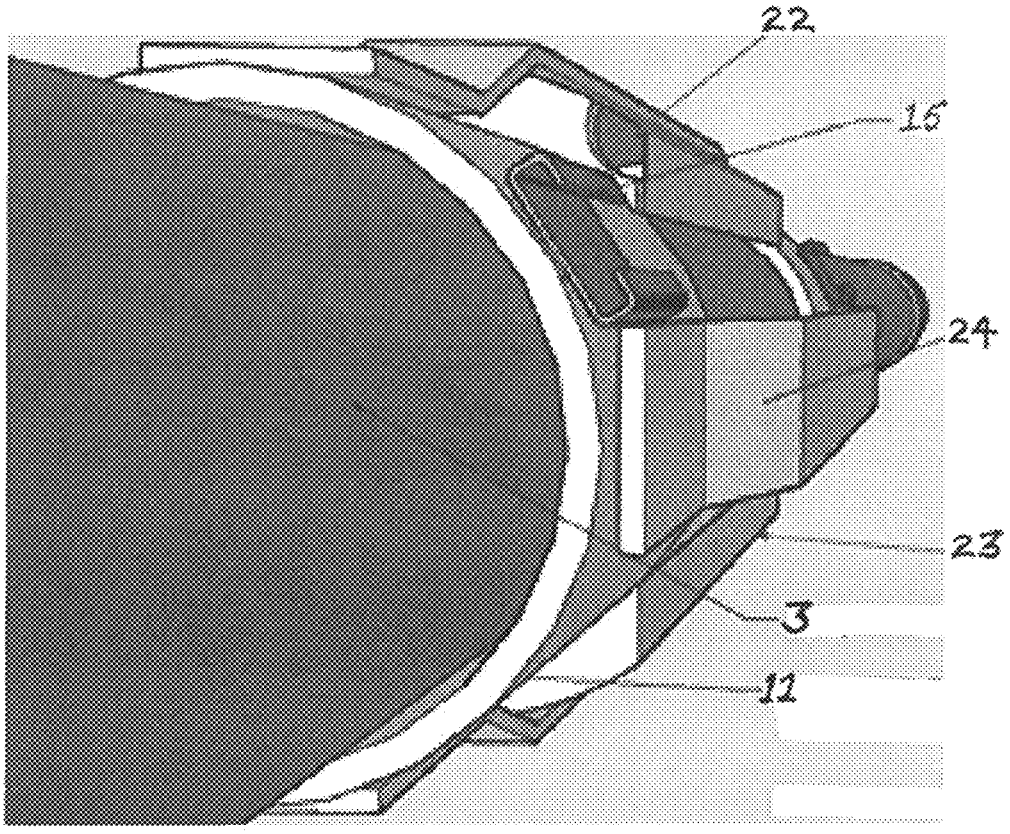
FIG. 15B illustrates a perspective view taken from one end of the cable carrier orientation system shown in FIG. 15A.

Looking now at FIG. 15B, illustrated is a perspective view taken from one end of the carrier orientation system shown in FIG. 15A. From this perspective view, the structure and shape of the bow springs 24 operating as the centralizing devices may better be seen. In addition, the location and orientation of the clip 15 on the casing 3 may also be seen. As with the embodiments discussed above, as the carrier 11 rotates around the casing 3 with the assistance of the buoyancy device 22 and/or the weighting device 23, the bow springs 24 will keep the casing 3 and carrier 11 substantially concentric within the wellbore wall. Therefore, the width of each of the bow springs 24 may be selected so that the carrier 11 is still permitted to rotate within the wellbore, while still keeping the carrier 11 and casing 3 substantially concentric.

Figure 16:
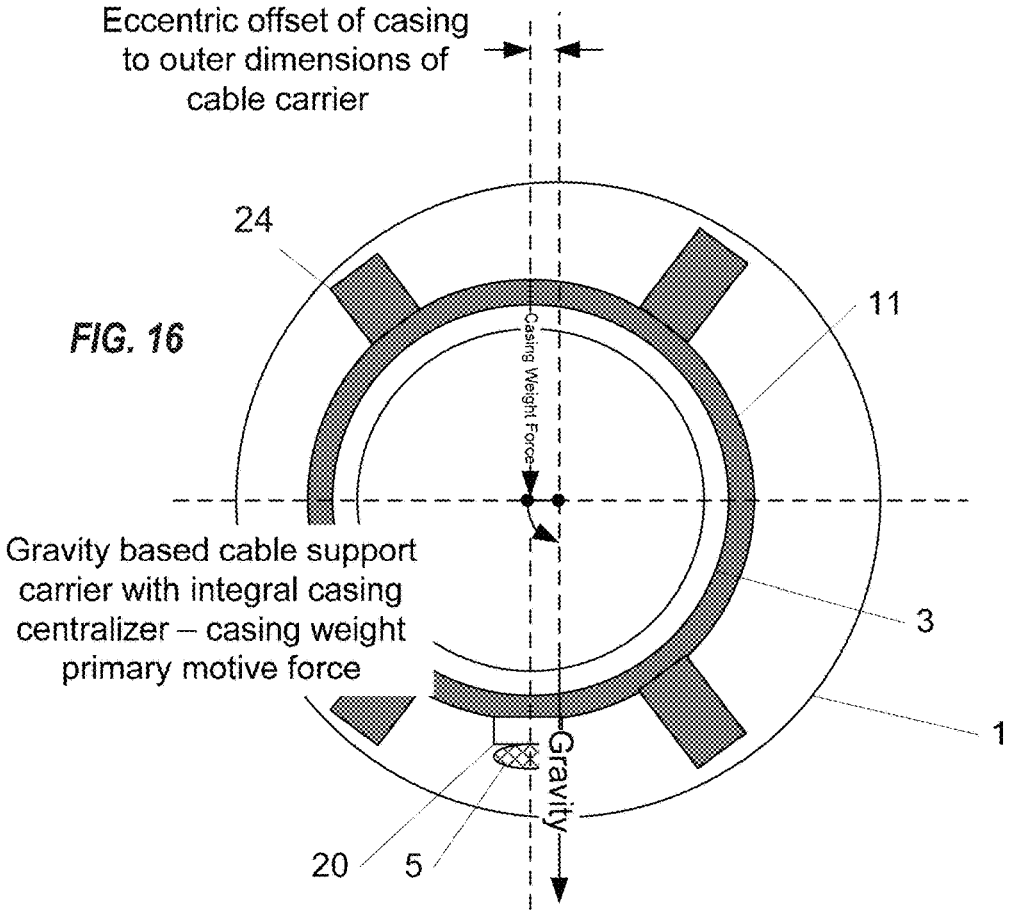
FIG. 16 illustrates a top view of another embodiment of a carrier orientation system in accordance with the disclosed principles, and which employs the weight of the casing to automatically orient the rotational position of the parameter detecting device.

Turning now to FIG. 16, illustrated is another embodiment of a carrier orientation system in accordance with the disclosed principles, and which employs the weight of the casing to automatically orient the rotational position of the parameter detecting device. In this embodiment, the diameter of the casing 3 (and thus the carriers 11) is laterally offset by a predetermined amount, as illustrated. In an advantageous embodiment, the offset amount is substantially equal to the outer dimensions of the carrier 11; however, other offset amounts may also be employed. By laterally offsetting the casing 3, the weight of the casing 3 can be employed as the weighting device such that the offset side (i.e., the left side of the casing 3 in FIG. 16) of the casing 3 is drawn in the direction of gravitational pull by the sheer weight of the casing 3 itself. Since this is the case in non-vertical wellbores 1, the cable 5 or other parameter detecting device can be located on a chosen side of the carrier 11 such that its location will be known as the eccentric casing 3 is drawn downward and the thus the carrier 11 rotates to a known position around the casing 3. In application, as the casing 3 and carriers 11 are slid into the wellbore 1, the weight of the eccentric casing 3 causes the carriers 11 to rotate towards the pull of gravity, thereby automatically orienting the rotational position of the parameter detecting devices into the desired position. For example, a 40 foot joint of 5½ inch casing, which can each have a carrier 11 there on holding the cable 5 or other parameter detecting device, can have a weight of approximately 23 pounds per linear foot. Thus, each 40 foot joint would weigh about 920 lbs. Thus, the high weight of each joint of casing 3 would bias each carrier 11 towards the pull of gravity. Additionally, stabilizing devices 24 may be employed similar to the centralizing devices discussed above, but sized so as to maintain the eccentric orientation of the carriers 11 and casing 3. As before, these stabilizing devices 24 may be comprised of any of a number of structures, such as bow springs, blades or rollers, or any other advantages structures. The combination of these structural features will force the orientation of the carrier 11 with respect to the casing 3 to a specific position, which in turn causes the cable 5 or other parameter detecting device(s) to a known location or rotational orientation.

Figure 17:
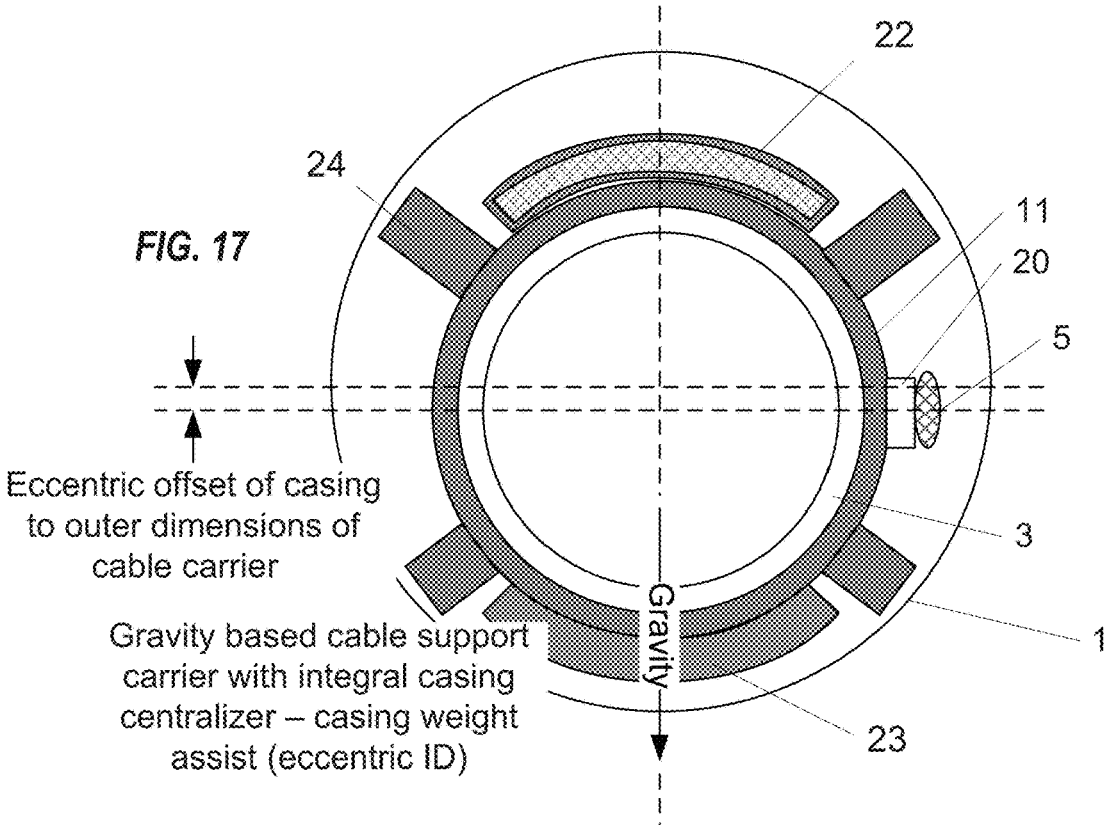
FIG. 17 illustrates a top view of another embodiment of a carrier orientation system having eccentrically oriented carriers and casing in accordance with the disclosed principles.

Looking now to FIG. 17, illustrated is another embodiment of a carrier orientation system having eccentrically oriented carriers and casing in accordance with the disclosed principles. In this embodiment, the carrier orientation system includes the addition of a buoyancy device 22 and a weighting device 23 in combination with the offset casing 3. As illustrated, the carriers 11 and casing 3 are vertically offset due to the movement of the heavy casing 3 in the direction of gravitational pull. Specifically, the downward offset of the casing 3 causes the weight of the offset side of the casing 3 to self-orient the carrier 11 towards the pull of gravity. This is in addition to the draw of the weighting device 23 also towards the pull of gravity, and thus the weight of the casing 3 and the weighting device 23 work together to automatically orient the location of the carrier 11, and thus the cable 5 or parameter detecting device(s). Moreover, the opposing location of the buoyancy 22 from the weighting device 23 further assists the rotational movement of the carrier 11 (in this case in the direction opposite to the pull of gravity), and thus further assists the automatic orientation of the cable 5 or other parameter detecting device. It should also be noted that in these embodiments, the cable 5 or other parameter detecting device may itself be one or both of the buoyancy device 22 or the weighting device 23 rather than separate buoyancy and/or weighting devices.

Figure 18:
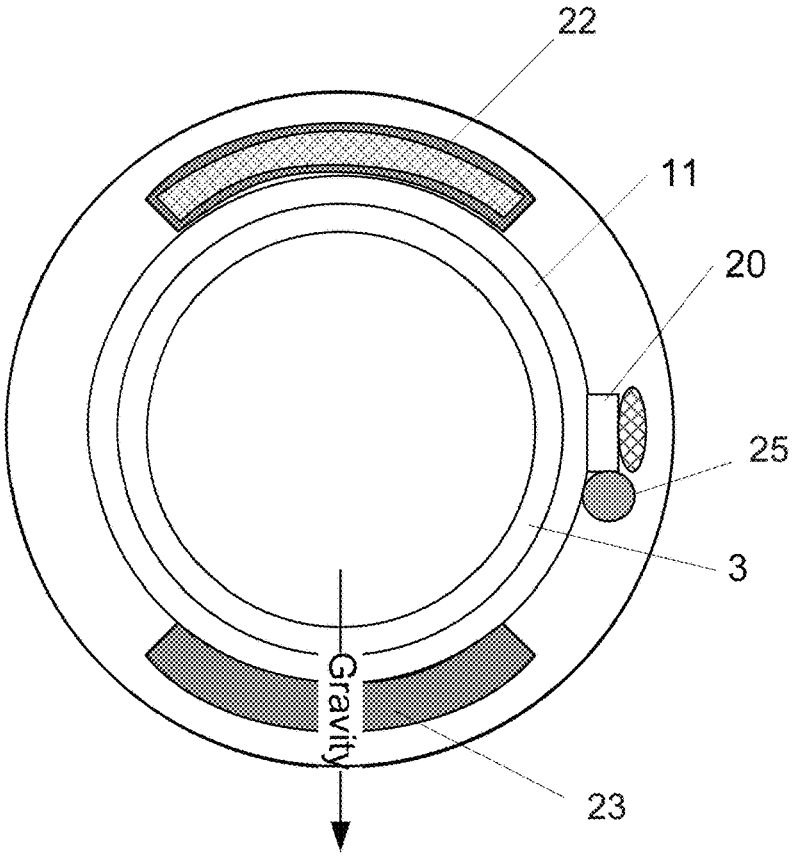
FIG. 18 illustrates a top view of one embodiment of a carrier orientation system in accordance with the disclosed principles in combination with a position reporting device.

Turning now to FIG. 18, illustrated is one embodiment of a carrier orientation system in accordance with the disclosed principles in combination with a position reporting device. Specifically, beacons or other devices are available to transmit its rotational position within a wellbore. Such beacons or other devices may thus be placed proximate to the communication cable 5 or other parameter detecting device, as illustrated, to transmit the location of the parameter detecting device. However, this information alone is not sufficient if the transmitted location of the parameter detecting device is actually in an undesirable location, such as where a charge needs to be detonated. Thus, any of the carrier orientation systems in accordance with the disclosed principles may be employed with such beacons or similar location information providing devices to confirm that the location or rotational position of the cable of other parameter detecting device is where it is desired using a disclosed carrier orientation system.

Figure 19:
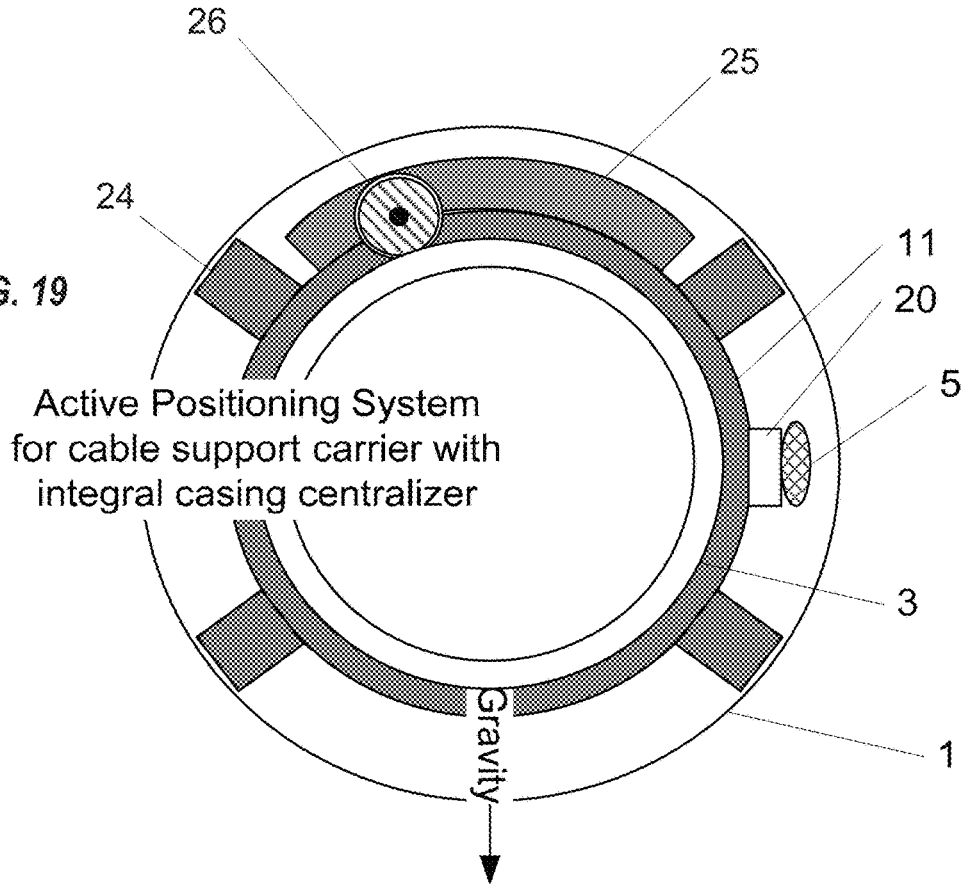
FIG. 19 illustrates a top view of one embodiment of a carrier orientation system using an active positioning system in accordance with the disclosed principles.

In addition to the carrier orientation systems discussed above, other embodiments in accordance with the disclosed principles could include an active, as opposed to passive, system for actively adjust the orientation of the carriers 11, and thus the cable 5 or other parameter detecting device, after the casing 3 and carriers 11 have been deployed in a wellbore 1. Looking at FIG. 19, illustrated is one embodiment of a carrier orientation system using an active positioning system in accordance with the disclosed principles. Embodiments of such an active positioning system would use a powered system on or within the cable carriers 11 that would be capable of turning the carrier(s) 11 within the wellbore 1 to the desired orientation. Actuators, such as electric or hydraulic motors, electrical solenoids, hydraulic pistons, and/or other powered devices could be used to apply a rotational force to the carrier 11 by applying wheels, pads, slips, or other types of gripping devices either against the casing 3 or the wellbore wall 1.

For example, in the embodiment illustrated in FIG. 19, the active system may include a motor and positioning logics module 25. The logics module 25 would include the circuitry and instruments for determining and providing the positioning information of the carrier 11, and in turn the location and rotational position of the cable or other parameter detecting device. In addition, the logics module 25 may also include the motor or other actuator used to provide the positioning of the carrier 11. The illustrated active positioning system also includes a drive wheel or gear 26 powered by the actuator. In this embodiment, the drive wheel 26 has its contact surface with the exterior of the casing 3. As the actuator turns the drive wheel 26, the wheel 26 actively adjusts the rotational position of the carrier 11 with respect to the casing 3. As this rotational position is adjusted, in either direction, the logics module 25 determines the positioning between the two and can provide that information to a user via a control terminal, application, or other means of display to the user. The user may then not only determine the precise position of the cable 5 or other parameter detecting device, but can adjust that location in any direction as needed. Also as illustrated, the powered system may again include centralizing devices 24 or other sized stabilizing devices for assisting with positioning of the carrier 11 and casing 3 within the wellbore 1.

The power source for the carrier 11 could be electrical power provided from the cable 5 or other parameter detecting device(s), or alternatively from on-board batteries, hydraulic power from control lines, or other means. Sensors within or attached to the carrier 11 or the logics module 25, such as gravity or other directional sensors, could also be employed to provide the signals to determine the amount of orientation correction needed to reposition the carrier 11 using the power actuators. The use of directional sensors, such as gyroscopic sensors, accelerometers, electronic compass sensor, and others, could be used to automatically provide correction signals to the power section of the carrier 11 when gravity-based sensors are not operable or applicable, such as in true vertical wells. Beacons, such as those locational beacons or similar devices discussed above, could also be employed to provide precise location of the carrier 11 and/or the parameter detecting device(s).

Figure 20:
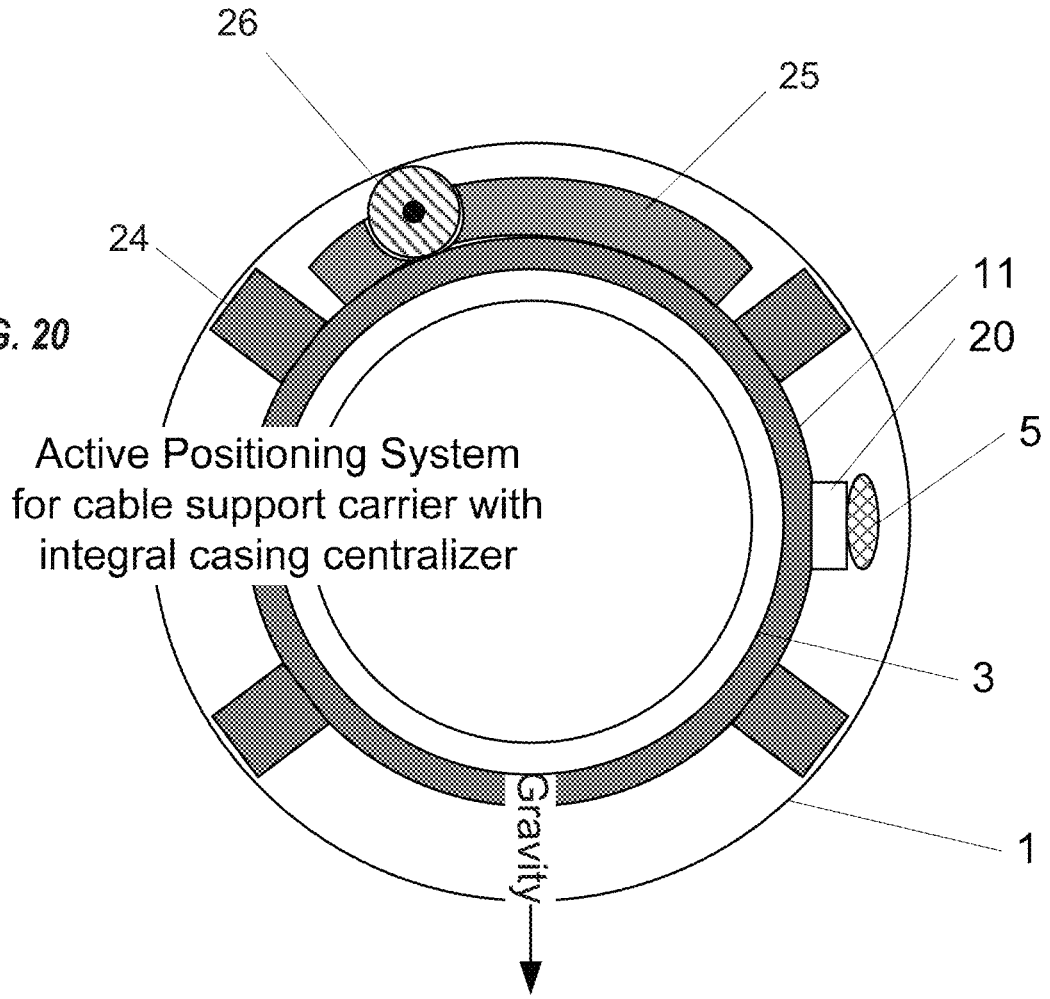
FIG. 20 illustrates a top view of another embodiment of a carrier orientation system using an active positioning system in accordance with the disclosed principles.

Turning to FIG. 20, illustrated another embodiment of a carrier orientation system using an active positioning system in accordance with the disclosed principles. In this embodiment, the an active positioning system would still include a powered system on or within the cable carriers 11 that would be capable of turning the carrier(s) 11 within the wellbore 1 to the desired orientation. Actuators, such as electric or hydraulic motors, electrical solenoids, hydraulic pistons, and/or other powered devices would again be used to apply a rotational force to the carrier 11 by applying wheels, pads, slips, or other types of gripping devices either against the casing 3 or the wellbore wall 1. In the embodiment, the drive wheel or gear 26 powered by the actuator(s) within the logics module 25 has its contact surface with the interior of the wellbore wall 2. As the actuator turns the drive wheel 26, the wheel 26 actively adjusts the rotational position of the carrier 11 with respect to the casing 3, but in these embodiments by driving the wheel 26 against the wellbore wall 2. The weight and length of the casing 3 would be sufficient to keep the position of the casing 3 steady while the carrier 11 rotated around the exterior of the casing 3. As before, as the rotational position is adjusted, in either direction, the logics module 25 again determines the positioning between the two and can provide that information to a user via a control terminal, application, or other means of display to the user. The user may then not only determine the precise position of the cable 5 or other parameter detecting device, but can adjust that location in any direction as needed. Also as before, this embodiment of the powered system may again include centralizing devices 24 or other sized stabilizing devices for assisting with positioning of the carrier 11 and casing 3 within the wellbore 1.

Preferred Embodiment Operational View of Cable Feeder Assembly

Figure 10:
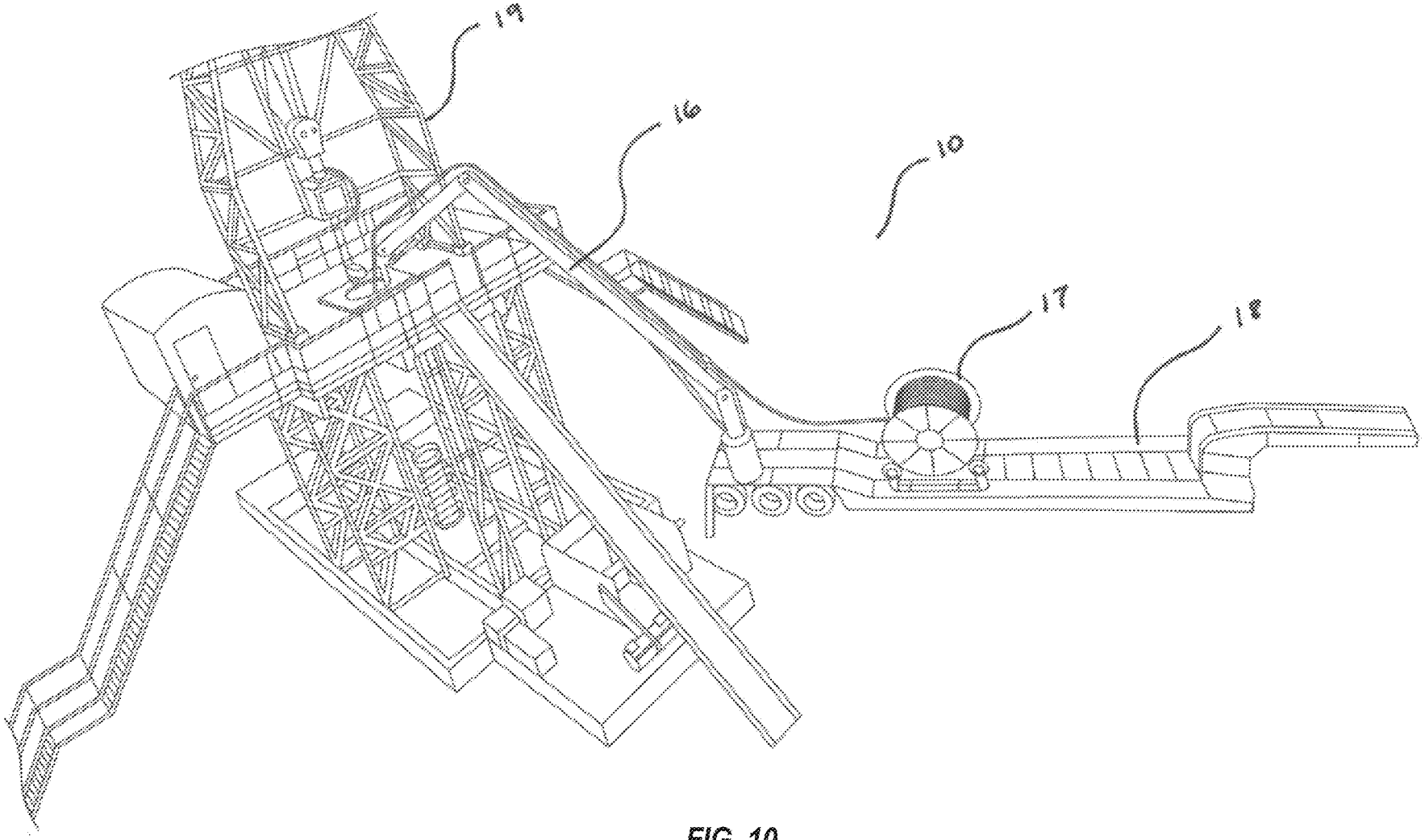
FIG. 10 illustrates an operational view of an embodiment of the cable feeder assembly 10 depicting the articulating hydraulic arm 16 and cable spool 17 mounted on a flatbed trailer situated adjacent to a drilling rig 19.

In another preferred embodiment shown in FIG. 10, an exemplary cable feeder assembly 10 deploys the flexible polymer cable 5 to the drilling rig 19 by an articulating hydraulic arm 16 that may be mounted on a flatbed trailer 18 along with a cable spool 17. The cable 5 feeds from the spool 17 along the articulating arm 16 to the drilling rig 19.

Figure 11:
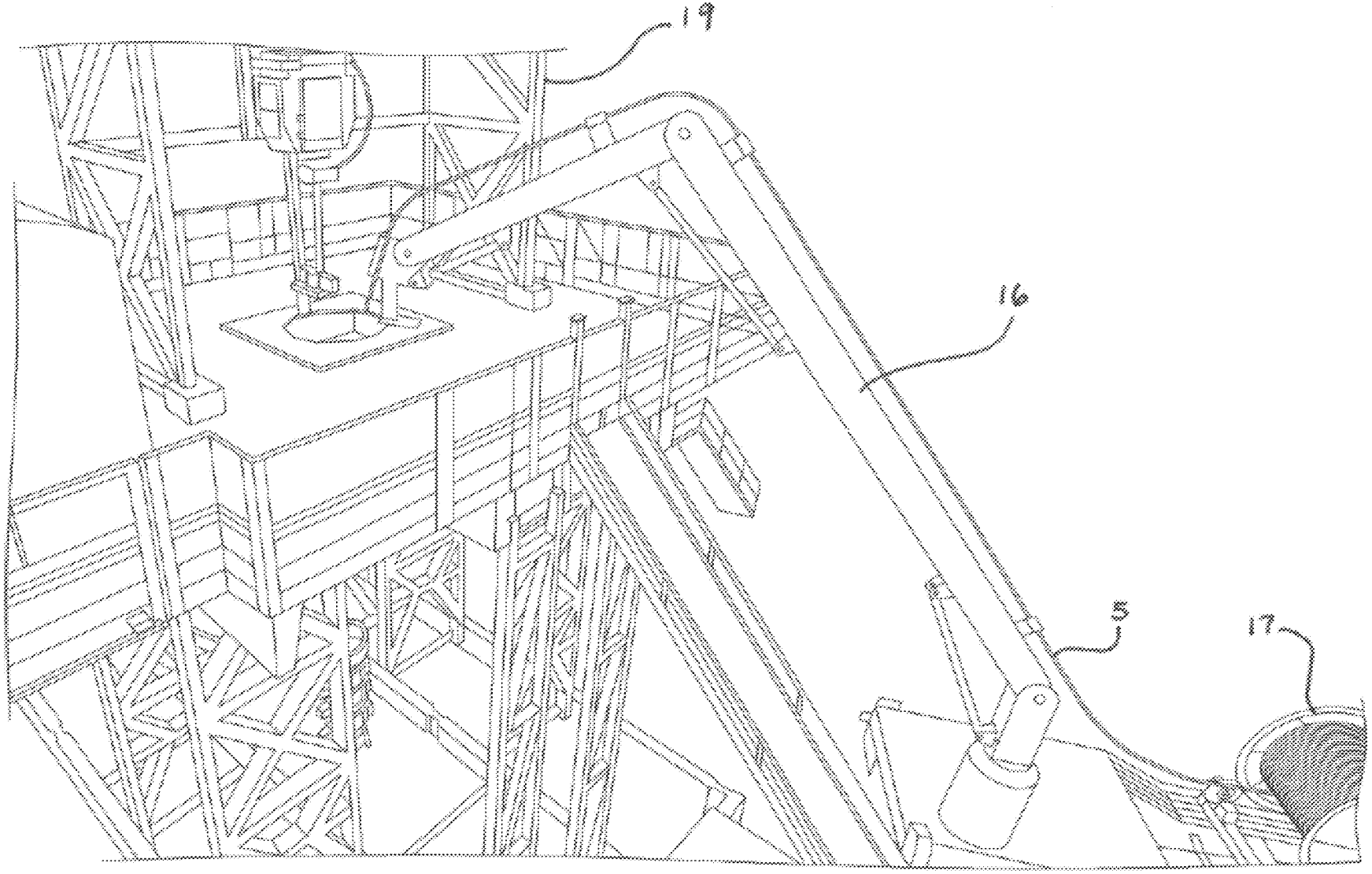
FIG. 11 illustrates an enlarged operational view of an embodiment of the articulating hydraulic arm 16 attached to the drilling rig 19.

FIG. 11 provides an enlarged operational view of the articulating hydraulic arm 16 and the cable 5 feeding from the spool 17 along the articulating arm 16 to the drilling rig 19.

Figure 12:
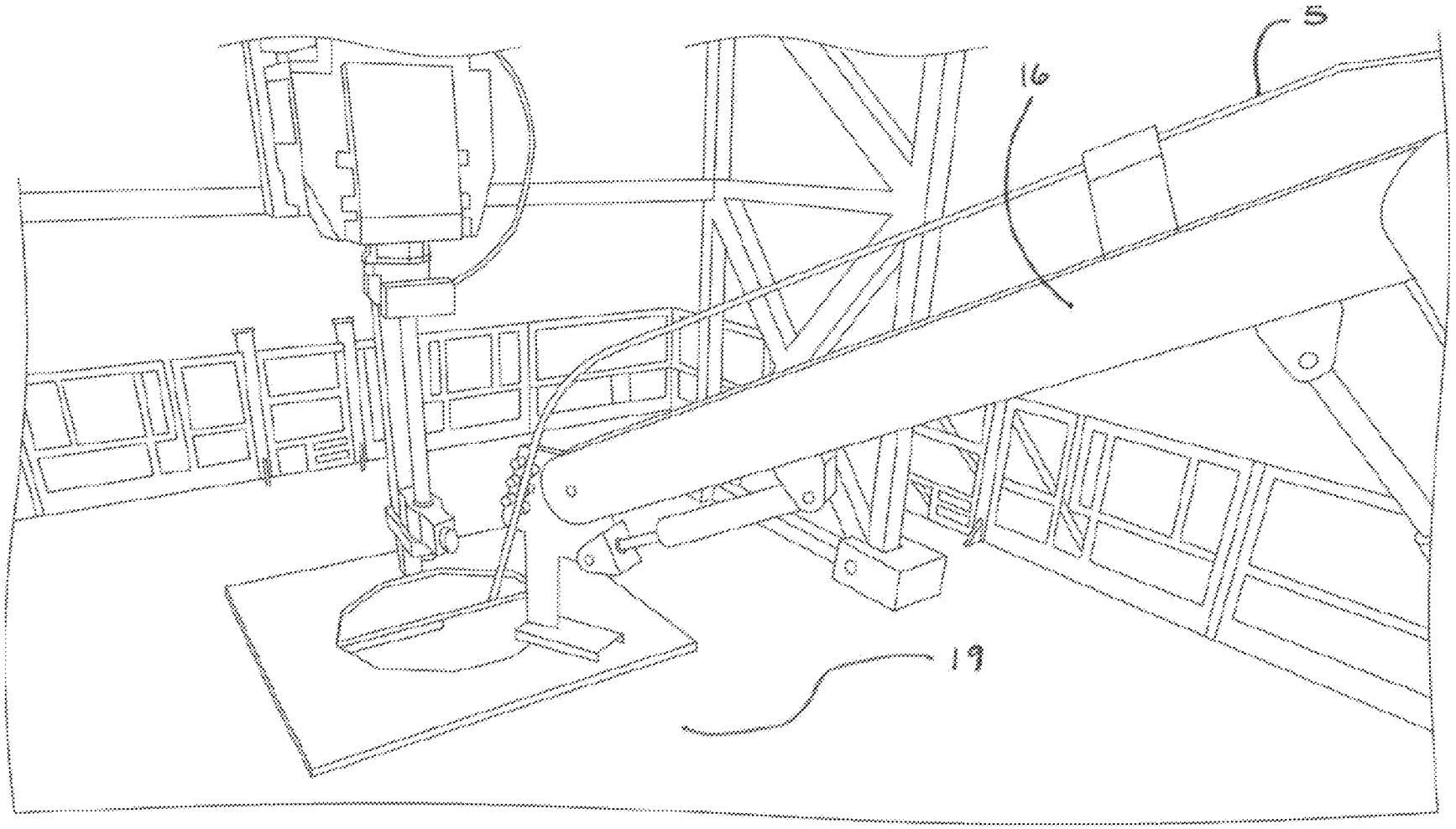
FIG. 12 illustrates an enlarged operational view of an embodiment of the articulating hydraulic arm 16 attached to the drilling rig 19 where the flexible polymer cable 5 feeds down to the wellbore 1.

FIG. 12 provides another enlarged operational view of the articulating hydraulic arm 16 attached to the drilling rig 19. The flexible polymer cable 5 feeds along the articulating hydraulic arm 16 toward the drilling rig 19.

System Summary

The present invention system anticipates a wide variety of variations in the basic theme of extracting gas utilizing wellbore casings, but can be generalized as a wellbore isolation plug system comprising:

(a) A flexible polymer cable with embedded wires, (b) A system for handling said flexible polymer cable, (c) A means to hold the flexible polymer cable along a casing wall surface to allow distributed sensing of at least one wellbore parameter; and (d) A cable feeder assembly that feeds the flexible polymer cable from the spool to the drilling rig and into the bore hole;

Wherein

The system is configured to feed the flexible polymer cable into a wellbore; and The system is configured to allow rotation of the wellbore casing or tubing within the longitudinal axis of cable carriers; and The anchor subassembly and the intermediate cable carriers are configured to support the weight of the flexible polymer cable in the downhole environment.

This general system summary may be augmented by the various elements described herein to produce a wide variety of invention embodiments consistent with this overall design description.

Method Summary

The present invention method anticipates a wide variety of variations in the basic theme of implementation, but can be generalized as an instrumented wellbore cable and sensor system comprising:

a) A flexible polymer cable with embedded wires, b) A system for handling and feeding said flexible polymer cable into a wellbore, c) A means to hold the flexible polymer cable along a casing wall surface to allow sensing of at least one wellbore parameter;

Wherein the method comprises the steps of:

(1) installing wellbore casing;

(2) deploying flexible polymer cable along with the anchor subassembly and intermediate cable carriers to a desired wellbore location in the wellbore casing;

(3) activating the sensor or communication cables embedded in flexible polymer cable at the desired wellbore location;

(4) Gathering desired geophysical data.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the system is further configured to be deployed from a cable spool using a hydraulic, articulating arm mounted on a flat-bed trailer adjacent to a drilling rig.

An embodiment wherein the system is further configured to allow a hydraulic articulating arm to attach to a drilling rig and guide a flexible polymer cable to the drilling rig.

An embodiment wherein the system is further configured to allow the annulus space between the casing and the wellbore to be cemented after deploying the instrumented sensor cable system to the desired wellbore location.

An embodiment wherein the formed metal jacket completely encapsulates the ruggedized sensor cable element.

An embodiment wherein the intermediate cable carriers are fabricated from material that is selected from a group consisting of: aluminum, iron, steel, titanium, tungsten, and carbide.

An embodiment wherein the flexible polymer cable material is selected from a group consisting of: a non-metal, a low-friction polymer, an erosion resistant polymer, and a metal or ceramic sheath.

An embodiment wherein the shape of the ruggedized flexible polymer cable shape is selected from a group consisting of: a flattened sphere, a crescent, an ellipse, a flattened rectangle and a flat cable.

An embodiment wherein the shape of the flexible polymer cable is a flattened ellipse or rectangle.

One skilled in the art will recognize that other embodiments are possible based on combinations of elements taught within the above invention description.

Conclusion

An instrumented wellbore cable and sensor deployment system and method for rapid deployment of fiber optic distributed sensing cables, conventional electronic cables, or hydraulic control lines in the annulus of a wellbore without the need to clamp cables to the casing or tubing string for support.

What is claimed is:

1. An instrumented wellbore deployment system, comprising:

at least one parameter detecting device capable of sensing at least one wellbore parameter;

a series of carriers configured to be arrayed at spaced intervals along a casing deployed in a wellbore such that the casing may rotate freely within the carriers and suspend the at least one parameter detecting device separated from the casing; and a carrier orientation system on one or more of the carriers configured to automatically adjust rotational orientation of each of the one or more carriers with respect to the casing and the wellbore, thereby establishing location of the at least one parameter detecting device within the wellbore.

2. The system of claim 1, wherein the carrier orientation system comprises a buoyancy device on one or more of the carriers, each buoyancy device configured to have buoyancy within fluid in the wellbore and thereby automatically adjust the rotational orientation of each of the one or more carriers.

3. The system of claim 2, wherein the at least one parameter detecting device comprises the buoyancy device.

4. The system of claim 1, wherein the carrier orientation system comprises a weighting device on one or more of the carriers, each weighting device drawn in the direction of gravity and thereby automatically adjusts the rotational orientation of each of the one or more carriers.

5. The system of claim 4, wherein the at least one parameter detecting device comprises the weighting device.

6. The system of claim 1, wherein the carrier orientation system comprises:

a buoyancy device on a first side of one or more of the carriers, each buoyancy device configured to have buoyancy within fluid in the wellbore; and a weighting device on a second side, opposite the first side, of the one or more of the carriers, each weighting device drawn in the direction of gravity;

wherein the buoyancy device and weighting device on each of the one or more carriers together automatically adjust the rotational orientation of each of the one or more carriers.

7. The system of claim 1, wherein the carrier orientation system comprises a plurality of centralizing devices attached to each of the one or more carriers, the centralizing devices configured to position the casing and carriers substantially concentric within the wellbore.

8. The system of claim 7, wherein the centralizing devices comprise blades, bow springs, or rollers.

9. The system of claim 1, wherein the carrier orientation system comprises a powered system having one or more actuators configured to apply rotational force to the one or more carriers and thereby adjust the rotational orientation of each of the one or more carriers.

10. The system of claim 9, wherein the one or more actuators are configured to apply rotational force to the one or more carriers and thereby adjust the rotational orientation of each of the one or more carriers based on user input provided to the powered system.

11. The system of claim 10, further comprising a drive device positioned between the carrier and the casing, and powered by the one or more actuators to apply the rotational force.

12. The system of claim 10, wherein power for the powered system is provided via the at least one parameter detecting device.

13. The system of claim 1, wherein the at least one parameter detecting device comprises a communication cable having communication conduits embedded therein.

14. The system of claim 13, wherein the communication cable comprises a plurality of fiber optic cables, electrical wires, communication wires, or magnetic sensing wires.

15. The system of claim 1, wherein the at least one parameter detecting device comprises a pressure sensing device capable of determining pressure within at least a portion of the wellbore.

16. The system of claim 1, wherein the at least one parameter detecting device comprises a temperature sensing device capable of determining temperature within at least a portion of the wellbore.

17. The system of claim 1, wherein the at least one parameter detecting device comprises a seismic sensor capable of detecting seismic activity, or an acoustic device capable of emitting acoustic waves to determining at least one parameter within at least a portion of the wellbore.

18. The system of claim 1, wherein the system further comprises a corresponding beacon located proximate to each of the at least one parameter detecting device, and configured to transmit a location within the wellbore.

19. The system of claim 1, wherein the casing and one or more carriers are eccentric with respect to the diameter of the wellbore, and wherein weight of the casing is drawn in the direction of gravity to thereby automatically adjust the rotational orientation of each of the one or more carriers.

20. The system of claim 19, wherein the diameter of the casing is offset with respect to the diameter of the wellbore by about the outer dimension of the one or more carriers.

* * * * *